United States Patent [19]

Patel

[11] Patent Number: 4,802,673

[45] **Date of Patent: * Feb. 7, 1989**

[54] PUZZLE GAME

[76] Inventor: Narendrakumar M. Patel, 59 Deerfield Rd., Parsippany, N.J. 07054

[ * ] Notice: The portion of the term of this patent subsequent to Mar. 22, 2005 has been disclaimed.

[21] Appl. No.: 149,855

[22] Filed: Jan. 29, 1988

Related U.S. Application Data

[63] Continuation-in-part of Ser. No. 926,964, Nov. 4, 1986, Pat. No. 4,732,388.

[51] Int. Cl.[4] ..... A63F 9/08
[52] U.S. Cl. ..... 273/153 S
[58] Field of Search ..... 273/153 S

[56] References Cited

U.S. PATENT DOCUMENTS

| | | | |
|---|---|---|---|
| 526,544 | 9/1894 | Shriver | 273/153 S |
| 1,112,746 | 10/1914 | Wiley | 273/153 S |
| 4,548,410 | 10/1985 | Morrone | 273/153 S |
| 4,732,388 | 3/1988 | Patel | 273/153 S |

FOREIGN PATENT DOCUMENTS

| | | | |
|---|---|---|---|
| 110186 | 10/1917 | United Kingdom | 273/153 S |
| 417143 | 9/1934 | United Kingdom | 273/153 S |

OTHER PUBLICATIONS

Scientific American, Feb. 1964, pp. 122,124,126.

*Primary Examiner*—Anton O. Oechsle
*Attorney, Agent, or Firm*—Anthony J. Casella; Gerald E. Hespos

[57] ABSTRACT

A puzzle is provided with a frame having a generally rectangular opening therein. The rectangular opening has a major dimension of four times a selected unit of measurement, and a minor dimension of three times the selected unit of measurement. Movably disposed within the rectangular opening are four substantially identical square puzzle pieces each of which has sides equal in length to the selected unit of measurement. The puzzle further comprises three substantially identical rectangular puzzle pieces each of which has minor sides equal to the selected unit of measurement and major sides equal to twice the selected unit of measurement. Selected pieces may be provided with indicia so that various selected patterns may be provided as the starting and ending points for different puzzle games.

20 Claims, 3 Drawing Sheets

FIG. 1
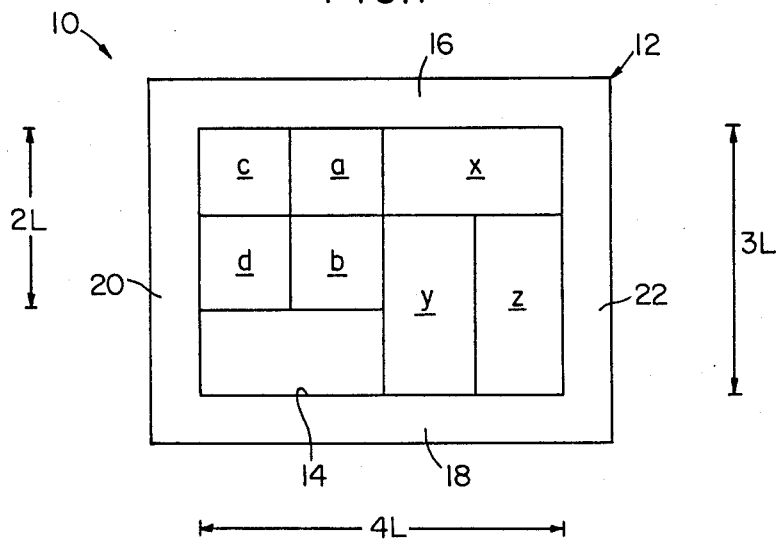
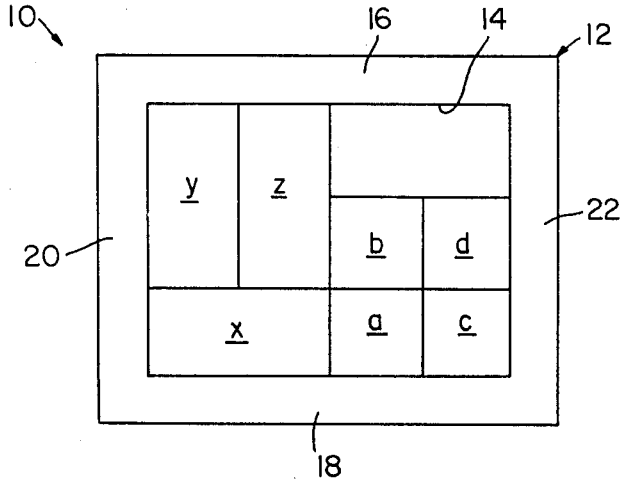
FIG. 2

PUZZLE GAME

CROSS-REFERENCE TO RELATED APPLICATION

This application is a continuation-in-part of U.S. patent application Ser. No. 926,964 filed Nov. 4, 1986 now U.S. Pat. No. 4,732,388.

BACKGROUND OF THE INVENTION

Many puzzles include a generally planar support, a generally rectangular frame attached to or unitary with the support and a plurality of pieces movably disposed within the frame. Typically, the area defined by the movable pieces will be smaller than the area defined by the frame. Thus, one or more empty spaces will exist in the area defined by the frame. The user of the puzzle or game sequentially moves the pieces into the one or more empty spaces thereby creating a new empty space. In this manner, the various members disposed within the frame can be moved relative to one another and relative to the frame.

In some puzzles of the general type described above, each puzzle piece disposed within the frame is provided with certain indicia, and the object of the puzzle is to sequentially move the pieces within the frame to either form an image, create a message or define some specified alphabetic or numeric order. Certain puzzles of this type employ movable pieces of different sizes and shapes. Other puzzles of this type may include one or more exits or entrances within the frame to facilitate or complicate the movement of the various pieces. On most puzzles of this type, the various puzzle pieces and the frame are formed with interlocking arrays of tongues and grooves or interlocking arrays of stepped edges to prevent the various puzzle pieces from becoming disengaged from the planar support and/or the frame. Generally larger puzzles with more pieces are easier in that they provide more room for maneuvering pieces.

It is an object of the subject invention to create an intriguing puzzle employing a plurality of pieces movably disposed within a frame.

It is another object of the subject invention to provide a puzzle having a plurality of rectangular pieces movably disposed within a rectangular frame.

Still another object of the subject invention is to provide a puzzle having a plurality of square pieces and a plurality of elongated rectangular pieces movably disposed within an elongated frame.

A further object of the subject puzzle is to provide a single puzzle having a plurality of rectangular pieces movably disposed within a rectangular frame and providing a plurality of separate puzzle games exhibiting varying degrees of difficulty and providing the user with a plurality of distinctly different challenges.

An additional object of the subject invention is to provide a puzzle game wherein the puzzle pieces are provided with indicia disposed to create varying patterns as puzzle pieces are rearranged.

SUMMARY OF THE INVENTION

The subject invention is directed to a puzzle having a plurality of rectangular pieces movably disposed within a frame. The principal object of the subject puzzle is to sequentially move the rectangular pieces within the frame from a first symmetrical or logical disposition of puzzle pieces to a second symmetrical or logical disposition of puzzle pieces, and/or to achieve selected designs with indicia on the puzzle pieces.

The frame of the puzzle of the subject invention defines a generally rectangular opening having an opposed pair of parallel major sides and an opposed pair of parallel minor sides. The pair of opposed parallel minor sides defined by the rectangular opening in the frame extends a distance of three times a selected unit of measurement in a first direction while the pair of opposed major sides extends a distance of four times the selected unit of measurement in a direction orthogonal to the first direction. More particularly, the opening of the frame defines an internally disposed rectangle having dimensions of three units by four units. The puzzle may further include a generally planar support panel attached to or unitary with the frame. However, it is anticipated that certain embodiments of the invention may not be provided with a generally planar support panel. In these embodiments, the frame may merely be placed upon a suitable generally planar surface, such as a table.

The puzzle further comprises four substantially identical square pieces each having four side edges extending one unit in each direction, and three substantially identical rectangular pieces each of which has minor and major side edges of one unit by two units respectively. The puzzle pieces are disposed in the frame such that two of the rectangular pieces have their respective major sides parallel to one another and parallel to the minor sides of the frame.

From the preceding description, it is apparent that the frame defines a rectangular opening of twelve square units (three units $\times$ four units $=$ 12 units). However, the movable pieces define a total area of only ten square units (one unit $\times$ one unit $\times$ four pieces $+$ one unit $\times$ two units $\times$ three pieces $=$ 10 units). From the preceding algorithm, it is apparent that there are two square units of empty space provided in the frame of the subject puzzle. Thus, there will always be either two spaced apart square open areas having dimensions of one unit by one unit or one rectangular open area having a dimension of one unit by two units.

The puzzle enables a plurality of different starting and finishing points that can be attempted by the user. In one particular puzzle game, the puzzle pieces may initially start with the two parallel rectangular pieces disposed adjacent one longitudinal end of the frame and the square pieces disposed at the other longitudinal end of the frame. In this game, the object may be to move the puzzle pieces such that the respective parallel rectangular pieces and square pieces become disposed at the opposite longitudinal ends of the frame.

The various movable pieces of the puzzle may have straight rectangular side edges without an ability to interlock with one another or with the rectangular frame. With this option, the user may readily arrange the pieces into one of the above described symmetrical or logically distributed initial dispositions. The user may then proceed to attempt to achieve a selected ending disposition of the puzzle pieces. The puzzler may also explore various options for new starting and finishing points.

A preferred embodiment of the above described puzzle includes indicia on selected pieces. More particularly, the indicia is disposed to define a selected pattern at a particular starting orientation of the puzzle pieces and to define a different selected pattern at the finishing point. The indicia may be formed by printed markings on the puzzle pieces, by forming each puzzle piece from visually distinct materials or by creating a groove or ridge at selected locations on certain of the puzzle pieces.

One preferred pattern of indicia consists substantially entirely of lines disposed at angles to the respective side edges of the puzzle pieces. For example, the lines may be straight or curved lines extending entirely across the puzzle pieces. In a particularly preferred embodiment, each of the four square puzzle pieces is provided with a line extending from a corner of the respective piece to a midpoint of an opposed side. The two parallel rectangular puzzle pieces are each provided with two lines. In particular, one of the two parallel rectangular puzzle pieces is provided with a pair of converging lines which extend from the corners on one longitudinal side of the puzzle piece to two quarter-points on the opposite longitudinal side of that rectangular puzzle piece. In this context, the quarter-points are defined as being the two locations disposed halfway between the midpoint of a side and the corners of the sam side. The other of the two parallel rectangular puzzle pieces is provided with a pair of lines which intersect at the midpoint of one longitudinal side and which diverge symmetrically therefrom to the quarter-points on the opposed longitudinal side. With this arrangement of indicia on the puzzle pieces, the puzzle pieces can be arranged to define an "X" when the parallel rectangular pieces are on one longitudinal half of the puzzle frame and the square puzzle pieces are on the other longitudinal half. This "X" design can be transformed into a diamond-shape by sequentially moving the puzzle pieces such that the respective parallel rectangular pieces and the square pieces are disposed in the opposite halves of the puzzle frame. These starting and ending arrangements are consistent with the starting and ending disposition of puzzle pieces as explained above. Additionally, this particular arrangement of indicia enables the puzzler to create a broad array of other starting and ending points.

In an alternate to the above described embodiment, the two parallel rectangular puzzle pieces may have substantially identical patterns of two lines. For example, each of the parallel rectangular pieces could have a pair of lines intersecting at the midpoint of one long side and diverging to the quarter-points of the opposite long side. Alternatively, each of the parallel rectangular pieces could have a pair of lines extending from the corners on one longitudinal side and converging toward the quarter-points of the opposite longitudinal side. These alternate embodiments enable many intersecting puzzle games to be created, including puzzles starting with an X-shape, a large diamond shape or two small diamond shapes. However, these alternate embodiments do not enable a puzzler to advance from a starting X-shape to a large diamond or the reverse.

Still other alternates may include generally diagonal indicia on all three rectangular puzzle pieces. With this embodiment the rectangular puzzle piece extending parallel to the major side of the frame may have a single diagonal line extending between opposed corners. Further, with this embodiment, all or some of the square pieces may have indicia as explained above.

Still other patterns of indicia can be employed with different starting and ending indicia designs and with different degress of difficulty.

BRIEF DESCRIPTION OF THE DRAWINGS

FIG. 1 is a top plan view of the puzzle game of the subject invention with the puzzle pieces disposed in a first position relative to one another.

FIG. 2 is a top plan view of the puzzle shown in FIG. 1 but with the pieces moved into a second disposition relative to one another.

DETAILED DESCRIPTION OF THE PREFERRED EMBODIMENT

Figure 3:
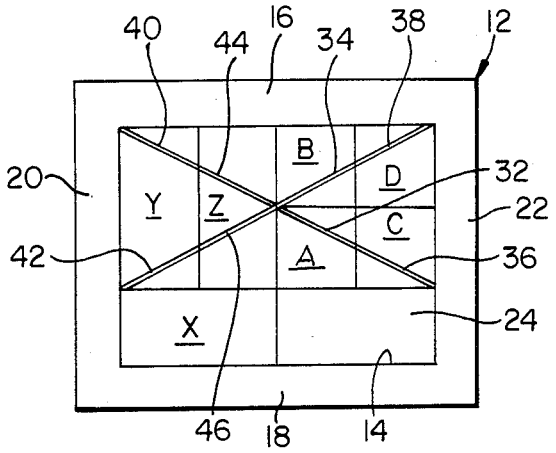
FIG. 3 is a top plan view of the puzzle shown in FIGS. 1 and 2 but with indicia disposed on selected puzzle pieces.

The puzzle of the subject invention is indicated generally by the numeral 10 in FIG. 1. The puzzle 10 includes a frame 12 defining a generally rectangular opening 14 therein. For ease of reference herein, the frame 12 will be further defined as including opposed top and bottom major sides 16 and 18 respectively and opposed left and right minor sides 20 and 22 respectively. The reference to the top and bottom herein is provided for convenient identification terminology only, and is not intended to reflect a specific gravitational orientation of the puzzle 10.

The rectangular opening 14 in the rectangular frame 24 is dimensioned such that the distance between the opposed top and bottom major sides 16 and 18 is three times a selected unit of measurement "L" or "3L" as shown in FIG. 1. Additionally, the distance between the opposed left and right sides 20 and 22 equals "4L" as shown in FIG. 1. In this context, the numerals preceding the "L" are coefficients which indicate that the dimensions of the opening 14 in frame 12 have a predetermined dimensional ratio relative to one another. Specifically, the distance between the opposed top and bottom sides 16 and 18 is approximately 75% the distance between the opposed left and right sides 20 and 22.

The puzzle 10 further comprises a planar bottom support 24 which is unitary with the frame 12. More particularly, the frame 12 and the bottom support 24 are molded from a unitary piece of plastic. However, in other embodiments of the subject invention, the frame 12 and the planar support 24 may be formed from separate members that are securely attached to one another. In still other embodiments the frame 12 may be employed on any convenient planar surface such as a table, without an integral or unitary planar support.

The puzzle 10 further includes four substantially identical generally planar square pieces a, b, c, and d which are movably disposed within the rectangular opening 14. Each square piece a–d has side dimensions of length "L" which is equal to one fourth the distance between the left and right sides 20 and 22 and one third the distance between the top and bottom sides 16 and 18. The letters a–d shown on the figures herein is provided only for the purpose of this specification and are not indicia that are required to play the puzzle game described herein.

The puzzle 10 further includes substantially identical generally planar rectangular pieces x, y, and z which are also slidably disposed within the rectangular opening 14 of frame 12. Each rectangular piece x–z has a major side dimension of two times the selected unit of measurement "L" or "2L" and a minor side dimension of "L" as indicated in FIG. 1. Thus, each rectangular piece x–z is substantially the size of two square pieces a–d. The rectangular piece x is disposed such that its major sides are parallel to the top and bottom major sides 16 and 18 of frame 12. The rectangular pieces y and z, however, are disposed such that their respective major sides are parallel to the left and right minor sides 20 and 22 of the frame 12.

As shown in FIG. 1, the square piece c is disposed in the corner defined by sides 18 and 22 of frame 12. The square piece a is disposed adjacent piece c and adjacent the bottom side 18, while the square piece d is adjacent c and the right side 22. Square piece b is adjacent both pieces a and d. Thus, the four square pieces a–d in the bottom right corner of frame 12. The rectangular piece x is disposed in the bottom left corner of frame 12, while rectangular pieces y and z are directly above rectangular piece x. Thus, as shown in FIG. 1, the parallel rectangular puzzle pieces y and z are in the left half of frame 12, while the square pieces are in the right half of frame 12. By sequentially performing a plurality of moves, it is possible to create a broad array of possible distributions of puzzle pieces a–d and x–z. The FIG. 1 distribution of puzzle pieces a–d and x–z within frame 12 was selected as a starting point because of the inherent balance of this distribution and because there is more than one possible initial move for a puzzler from this starting position. By carefully analyzing and selecting a sequence of moves of puzzle pieces a–d and x–z, it is possible to achieve a distribution of puzzle pieces as shown in FIG. 2. More particularly, in this distribution, the square puzzle pieces a–d are disposed in the left half of the rectangular opening 14 of frame 12 while the parallel rectangular puzzle pieces y and z are disposed in the right half of the rectangular opening 14. Furthermore, the disposition of puzzle pieces a–d and x–z shown in FIG. 2 precludes any subsequent moves without retracing moves that had previously been carried out.

Table 1 shows the sequence of moves to enable the puzzler to advance from the FIG. 1 distribution of puzzle pieces a–d and x–z to the FIG. 2 distribution. More particularly, the left column of Table 1 identifies the sequential number of the step to be carried out. The center column of Table 1 identifies the one or more puzzle pieces to be moved in each step and the right column of Table 1 identifies the direction of movement of those pieces. In each step set forth in Table 1 it is assumed that the puzzle pieces identified in the center column will be moved as far as possible in the direction indicated in the right column. The directional orientation set forth in Table 1 is consistent with the identification of the sides of frame 12 set forth above. More particularly, "up" refers to a movement toward the top side 16 of frame 12, while "down" refers to a movement toward the bottom side 18 of frame 12. Similarly, "left" refers to a movement toward the left side 20 of frame 12, while "right" refers to a movement toward the right side 22 of frame 12. Briefly, Table 1 shows that fifty-one properly sequenced moves will enable the puzzle to advance from the FIG. 1 distribution to the FIG. 2 distribution of puzzle pieces.

TABLE 1

| MOVE NUMBER | PIECE(S) | DIRECTION |
|---|---|---|
| 1 | a,b,c,d | up |
| 2 | x | right |
| 3 | y,z | down |
| 4 | b | left |
| 5 | z | up |
| 6 | x | left |
| 7 | c | down |
| 8 | a,b,z | right |
| 9 | y | up |
| 10 | x | left |
| 11 | b,z | down |
| 12 | d | left |
| 13 | a,c,z | up |
| 14 | x | right |
| 15 | b | down |
| 16 | b | left |
| 17 | d | down |
| 18 | y | right |
| 19 | b | up |
| 20 | d | left |
| 21 | d | up |
| 22 | x | left |
| 23 | c | down |
| 24 | c | left |
| 25 | a | down |
| 26 | b,y,z | right |
| 27 | d | up |
| 28 | x | up |
| 29 | a,c | left |
| 30 | y,z | down |
| 31 | b,d | right |
| 32 | c,x | up |
| 33 | a,y | left |
| 34 | d | down |
| 35 | b | left |
| 36 | b | down |
| 37 | x | right |
| 38 | a,c,y | up |
| 39 | d | left |
| 40 | b,y | down |
| 41 | x | left |
| 42 | z | up |
| 43 | b | right |
| 44 | a,y | right |
| 45 | c | down |
| 46 | x | left |
| 47 | y | up |
| 48 | b | left |
| 49 | y,z | down |
| 50 | x | right |
| 51 | a,b,c,d | up |

The puzzle 30 shown in FIGS. 3–7 is similar to the puzzle 10 described above and illustrated in FIGS. 1 and 2. More particularly, the puzzle 30 comprises a frame 12 identical to the frame depicted in FIGS. 1 and 2. The puzzle 30 further comprises four square pieces A, B, C and D which are dimensionally substantially identical to the puzzle pieces a, b, c and d shown in FIGS. 1 and 2. The puzzle further comprises three rectangular puzzle pieces X, Y and Z which are dimensionally substantially identical to the puzzle pieces x, y and z, shown in FIGS. 1 and 2 and described above. In particular, the puzzle piece X has its long axis extending parallel to the major sides 16 and 18 of the frame 12. The puzzle pieces Y and Z have their long axes parallel to the minor sides 20 and 22 of the frame 12.

The square puzzle pieces A–D and the rectangular puzzle pieces Y and Z each are provided with indicia as shown in FIGS. 3–7. The indicia provided on the square puzzle pieces A–D and rectangular puzzle pieces Y and Z is depicted as being formed by grooves in the respective puzzle pieces, with the grooves subsequently being dyed. However, other forms of indicia, such as a raised bead or a marking means may be employed for the indicia.

The square puzzle pieces A–D are provided respectively with lines 32, 34, 36 and 38. In particular, the lines 32–38 on the square puzzle pieces A–D are disposed to extend from a corner of the respective square puzzle pieces A–D to the midpoint of an opposite side. The rectangular puzzle pieces Y and Z each are provided with indicia defining two straight lines. In particular, the puzzle piece Y comprises lines 40 and 42 which extend from corners on one longitudinal side of the rectangular puzzle piece Y and converge toward one another to intersect the quarter-points of the opposed longitudinal side. As noted above, in this context; the quarter-points of a side are defined as being locations disposed 25% of the distance inwardly from the corners along a particular side. Thus, a quarter-point is disposed halfway between the midpoint of a side and the corresponding corner. The rectangular puzzle piece Z comprises a pair of lines 44 and 46 which extend from the quarter-points of one longitudinal side and converge to intersect at the midpoint of the opposed longitudinal side. The above described indicia on the square puzzle pieces A–D and the rectangular puzzle pieces Y and Z enables an X-shaped design to be created with the puzzle as shown in FIG. 3. It will be noted that the orientation of the puzzle pieces in FIG. 3 is substantially similar to the orientation of puzzle pieces depicted in FIG. 1 above. However, the presence of indicia on the puzzle pieces creates a distinct visual image and adds to the puzzle enjoyment and challenges.

Figure 4:
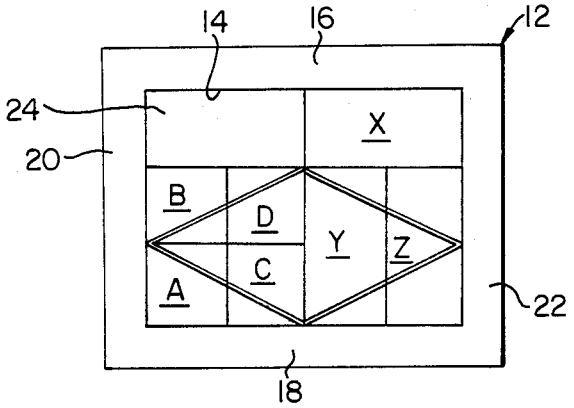
FIG. 4 is a top plan view of the puzzle shown in FIG. 3 but with the pieces moved into a second disposition relative to one another.

FIG. 4 shows an arrangement of puzzle pieces similar to FIG. 2 illustrated and described above. However, the indicia on the puzzle pieces effectively creates a diamond pattern. Consequently, the performance of the moves similar to those set forth in Table 1 above enables the puzzle to start with an X-shaped pattern as shown in FIG. 3 and to advance to a diamond-shaped pattern as shown in FIG. 4.

Figure 5:
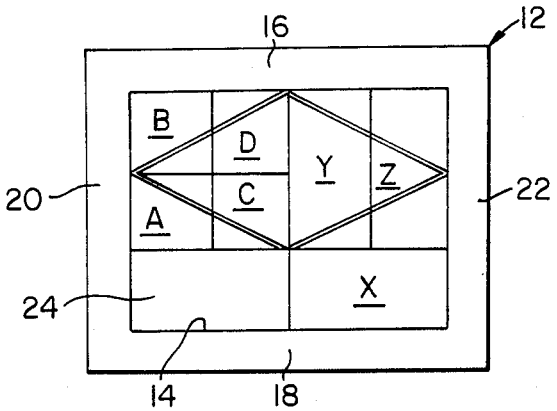
FIG. 5 is a top plan view of the puzzle shown in FIG. 3 but with the pieces moved into a third disposition relative to one another.

FIG. 5 shows an alternate solution for the puzzle 30. In particular, FIG. 5 also achieves the basic objective of advancing from an initial X-shaped pattern to a diamond shaped pattern. However, the orientation of puzzle pieces shown in FIG. 5 is clearly distinct from the orientation shown in FIG. 4 even though the FIG. 4 and FIG. 5 disposition of puzzle pieces each depict a diamond-shape. Consequently, the puzzler has at least a second end point and a second possible approach for achieving that end point.

Figure 6:
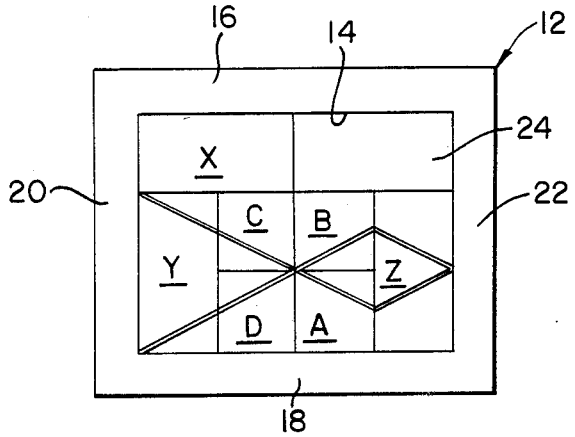
FIG. 6 is a top plan view of the puzzle shown in FIG. 3 but with the puzzle pieces disposed in a fourth disposition relative to one another.
Figure 7:
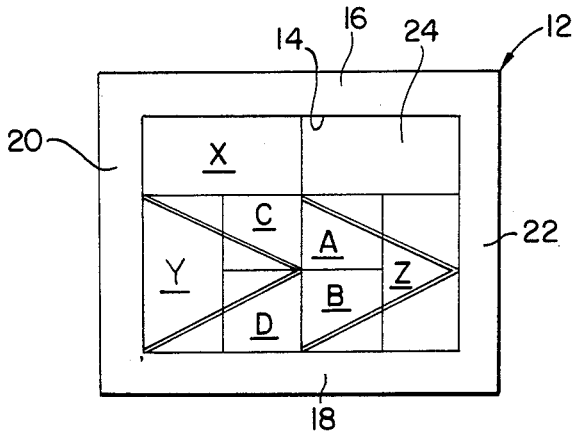
FIG. 7 is a top plan view of the puzzle shown in FIG. 3 but with the pieces moved into a fifth disposition relative to one another.

The puzzle 30 with the indicia thereon, as shown in FIGS. 3–5 can be employed to create a host of other starting and ending points, thereby permitting the puzzler to create his or her own puzzle games of varying degrees of complexity. For example, FIG. 6 shows a starting point for a fairly simple puzzle game utilizing the same pieces as shown in FIGS. 3–5. In particular, the puzzle pieces as shown in FIG. 6 define an arrow shape formed by the indicia on puzzle pieces C, D and Y and a diamond-shape formed by the indicia on puzzle pieces A, B and Z. The arrow shape abuts an apex of the diamond-shape. The object of this puzzle, as shown in FIG. 7, is to move the pieces one at a time to effectively reverse pieces A and B and thereby create a design of two arrow-shapes pointing in the same direction. A pattern of moves for advancing from the FIG. 6 starting position to the FIG. 7 objective is shown in Table 2. Many other puzzle games can be created to yield different starting and ending patterns of indicia.

TABLE 2

| MOVE NUMBER | PIECE(S) | DIRECTION |
|---|---|---|
| 1 | X | right |
| 2 | C | up & left |
| 3 | D | up |
| 4 | A | left & up |
| 5 | B | down |
| 6 | A | right |
| 7 | D | down |
| 8 | C | right & down |
| 9 | X | left |

In summary a puzzle is provided including a frame having a generally rectangular opening disposed therein. More particularly, the rectangular opening in the frame defines opposed top and bottom sides of the frame and opposed left and right sides. The distance across the rectangular opening and between the opposed top and bottom sides thereof is substantially equal to three times a selected unit of measurement, whereas the distance across the rectangular opening and between the left and right sides is substantially equal to four times the selected unit of measurement. The puzzle further includes four square puzzle pieces the respective sides of which each equal the selected unit of measurement. The puzzle also includes three rectangular puzzle pieces each having a minor side dimension equal to the selected unit of measurement and a major side dimension equal to twice the selected unit of measurement. Two of the rectangular puzzle pieces have their major sides parallel to the left and right sides of the frame. Selected puzzle pieces can be provided with indicia thereon to enable puzzle games having different patterns of indicia for the starting and ending points. In particular, each of the square puzzle pieces may be provided with a line while the two parallel rectangular puzzle pieces may be provided with a pair of converging lines.

While the invention has been described relative to a preferred embodiment, it is obvious that various changes can be made without departing from the scope of the invention as defined by the appended claims.

What is claimed is:

1. A puzzle comprising:

a frame comprising opposed first and second major sides and opposed first and second minor sides extending between and connected to the major sides so as to define a generally rectangular opening in said frame, said rectangular opening having a major dimension measured parallel to said major sides and substantially equal to four times a selected unit of measurement, and a minor dimension measured parallel to said minor sides and being substantially equal to three times the selected unit of measurement such that a line connecting the midpoints of said major sides defines first and second halves of said opening adjacent the first and second minor sides respectively;

four substantially identical square puzzle pieces having side edges equal in length to the selected unit of measurement, said square puzzle pieces being movable within the rectangular opening of said frame and being initially disposed in the first half of the rectangular opening; and three substantially identical rectangular puzzle pieces, each said rectangular puzzle piece having a minor side dimension substantially equal to the selected unit of measurement and a major side dimension substantially equal to twice the selected unit of measurement, said rectangular puzzle pieces being movably disposed within said rectangular frame, two of said rectangular puzzle pieces having their major sides parallel to the minor sides of the frame and being initially disposed entirely within the second half of the opening therein, the remaining rectangular puzzle piece having its major side parallel to and adjacent one of said major sides of said frame, at least selected ones of said square and rectangular puzzle pieces having indicia thereon, whereby said square and rectangular puzzle pieces can be moved relative to said frame to achieve a selected distribution of said square and rectangular puzzle pieces such that said square puzzle pieces are entirely within the second half of said opening and the parallel rectangular puzzle pieces are entirely within the first half of the opening.

2. A puzzle as in claim 1 wherein the indicia is disposed on each of said square puzzle pieces and on the two rectangular puzzle pieces having their major sides parallel to the minor sides of the frame.

3. A puzzle as in claim 2 wherein the indicia on each of the square puzzle pieces comprises a generally straight line extending from a corner of each said square puzzle piece to the midpoint of one said side of said respective square puzzle piece.

4. A puzzle as in claim 3 wherein the indicia on one of said rectangular puzzle pieces having its major side parallel to the minor sides of the frame comprises a pair of generally straight lines extending from the midpoint of one said major side of said piece to the quarter-points of the opposed major side thereof, and wherein the indicia on the other rectangular puzzle pieces having its major sides parallel to the minor sides of the frame comprises a pair of generally straight lines extending from the corners on one major side thereof to the quarter-points along the other major side thereof.

5. A puzzle as in claim 1 wherein the indicia is defined by a groove formed in said puzzle pieces.

6. A puzzle as in claim 1 wherein the frame is of unitary construction.

7. A puzzle as in claim 1 further comprising a generally planar support secured to said major and minor sides of said frame and substantially covering said rectangular opening therein.

8. A puzzle as in claim 7 wherein the planar support and the frame are of unitary construction.

9. A puzzle comprising:

a frame comprising opposed first and second major sides and opposed first and second minor sides extending between and connected to the major sides so as to define a generally rectangular opening in said frame, said rectangular opening having a major dimension measured parallel to said major sides and substantially equal to four times a selected unit of measurement, and a minor dimension measured parallel to said minor sides and being substantially equal to three times the selected unit of measurement;

four substantially identical square puzzle pieces having side edges equal in length to the selected unit of measurement and each having indicia thereon extending from one corner of said respective square puzzle piece to the midpoint on an opposite edge thereof, said square puzzle pieces being movable within the rectangular opening of said frame; and three substantially identical rectangular puzzle pieces, each said rectangular puzzle piece having a minor side dimension substantially equal to the selected unit of measurement and a major side dimension substantially equal to twice the selected unit of measurement, said rectangular puzzle pieces being movably disposed within said rectangular frame, two of said rectangular puzzle pieces having their major sides parallel to each other and to the minor sides of the frame and the remaining rectangular puzzle piece having its major side parallel to said major sides of said frame, one of the two parallel rectangular puzzle pieces having a pattern of indicia extending from a midpoint of one major side thereof and diverging to the quarter-points of the opposed side, the other of the parallel rectangular puzzle pieces having a pattern of indicia extending from the corners on one major side thereof to the quarter-points on the opposite side thereof, whereby said square and rectangular puzzle pieces can be moved relative to said frame to achieve a selected pattern of indicia on said square and rectangular puzzle pieces.

10. A puzzle as in claim 9 wherein the indicia on said puzzle pieces comprises generally straight lines.

11. A puzzle as in claim 10 wherein the indicia is defined by grooves extending into said puzzle pieces.

12. A puzzle comprising:

a frame comprising opposed first and second major sides and opposed first and second minor sides extending between and connected to the major sides so as to define a generally rectangular opening in said frame, said rectangular opening having a major dimension measured parallel to said major sides and substantially equal to four times a selected unit of measurement, and a minor dimension measured parallel to said minor sides and being substantially equal to three times the selected unit of measurement;

four substantially identical square puzzle pieces having side edges equal in length to the selected unit of measurement and each of said square puzzle pieces being movable within the rectangular opening of said frame; and three substantially identical rectangular puzzle pieces, each said rectangular puzzle piece having a minor side dimension substantially equal to the selected unit of measurement and a major side dimension substantially equal to twice the selected unit of measurement, said rectangular puzzle pieces being movably disposed within said rectangular frame, two of said rectangular puzzle pieces having their major sides parallel to each other and to the minor sides of the frame and the remaining rectangular puzzle piece having its major side parallel to said major sides of said frame, a plurality of said square and rectangular puzzle pieces each having indicia thereon, whereby said square and rectangular puzzle pieces can be moved relative to said frame to achieve a selected pattern of indicia on said square and rectangular puzzle pieces.

13. A puzzle as in claim 12 wherein said indicia is disposed to define a generally X-shaped pattern in a first distribution of said puzzle pieces and to define a second pattern in a second distribution of said puzzle pieces.

14. A puzzle as in claim 13 wherein said second pattern is generally diamond-shaped.

15. A puzzle as in claim 12 wherein said indicia is defined by at least one line extending across a plurality of said square puzzle pieces and a plurality of said rectangular puzzle pieces and angularly aligned to the edges thereof.

16. A puzzle as in claim 15 wherein the indicia on said square puzzle pieces defines a line extending from a corner of said square puzzle piece to the midpoint of an opposite side of said square puzzle piece.

17. A puzzle as in claim 16 wherein indicia on one of said parallel rectangular puzzle pieces comprises a pair of lines intersecting at the midpoint of one major side thereof and diverging to intersect the opposed major side of said piece at the quarter-points thereof, and wherein indicia on the other of said parallel rectangular puzzle pieces comprises a pair of lines extending from the corners on one major side thereof and converging to intersect the quarter-points on the opposed sides thereof.

18. A puzzle as in claim 15 wherein indicia on at least one of the parallel rectangular puzzle pieces comprises a pair of lines intersecting at the midpoint of one major side thereof and diverging to intersect the opposed major side of said piece at the quarter-points thereof.

19. A puzzle as in claim 15 wherein the indicia on at least one of the parallel rectangular puzzle pieces comprises a pair of lines extending from the corners on one major side thereof and converging to intersect the opposed major side of the piece at the quarter-points thereof.

20. A puzzle as in claim 12 wherein said indicia is disposed to define a generally diamond-shaped pattern in a first distribution of said puzzle pieces and to define a second pattern in a second distribution of said puzzle pieces.

* * * * *